US005401093A

United States Patent [19]

Resnick

[11] Patent Number: 5,401,093

[45] Date of Patent: Mar. 28, 1995

[54] PORTABLE MEDICINE CABINET ARRANGEMENT

[76] Inventor: Michael Resnick, 3830 Huber La., Niles, Ill. 60714

[21] Appl. No.: 95,848

[22] Filed: Jul. 23, 1993

[51] Int. Cl.[6] ..... A47B 81/00; B42F 21/00

[52] U.S. Cl. ..... 312/234.1; 312/209; 312/291; 206/534; 220/259; 220/326

[58] Field of Search ..... 312/291, 209, 234.1, 312/234.2, 234.3; 206/534; 220/256

[56] References Cited

U.S. PATENT DOCUMENTS

| | | | |
|---|---|---|---|
| 3,405,836 | 10/1968 | Regis | 220/256 X |
| 3,530,818 | 9/1970 | Secondino | 206/534 |
| 3,587,517 | 6/1971 | Fites | 206/534 X |
| 4,663,621 | 5/1987 | Field et al. | 312/209 X |

FOREIGN PATENT DOCUMENTS

| | | | |
|---|---|---|---|
| 1446982 | 8/1976 | United Kingdom | 220/256 |

*Primary Examiner*—Kenneth J. Dorner
*Assistant Examiner*—David E. Allred
*Attorney, Agent, or Firm*—Richard W. Carpenter

[57] ABSTRACT

A portable, personal, medicine cabinet arrangement for holding medicines and other items required to help maintain a prescribed medication schedule for an individual. The cabinet includes a hollow body, forming a compartment with at least one shelf for holding medicines, and a pair of inner and outer hinged covers having spaces for storing various items of printed material. The material held by the inner cover can be read from either side of the cover.

20 Claims, 2 Drawing Sheets

FIG. 1
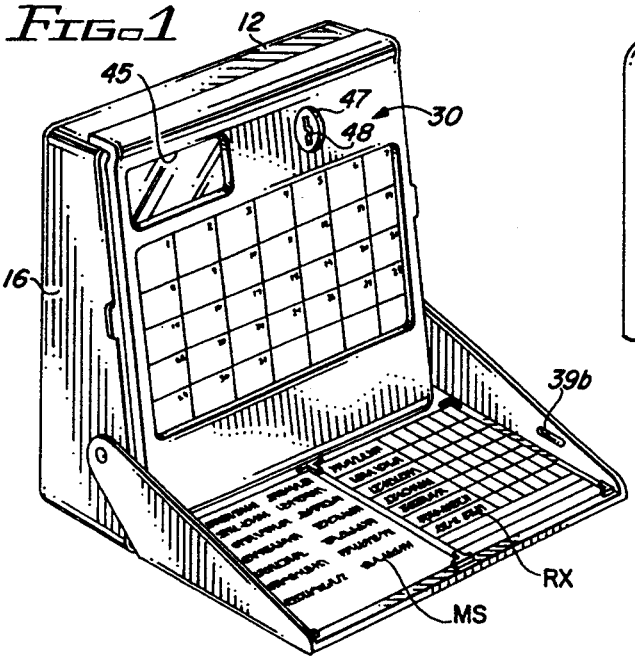
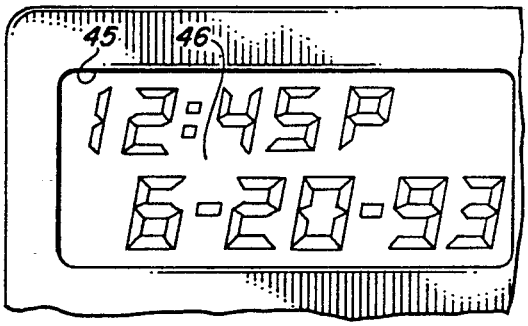
FIG. 5
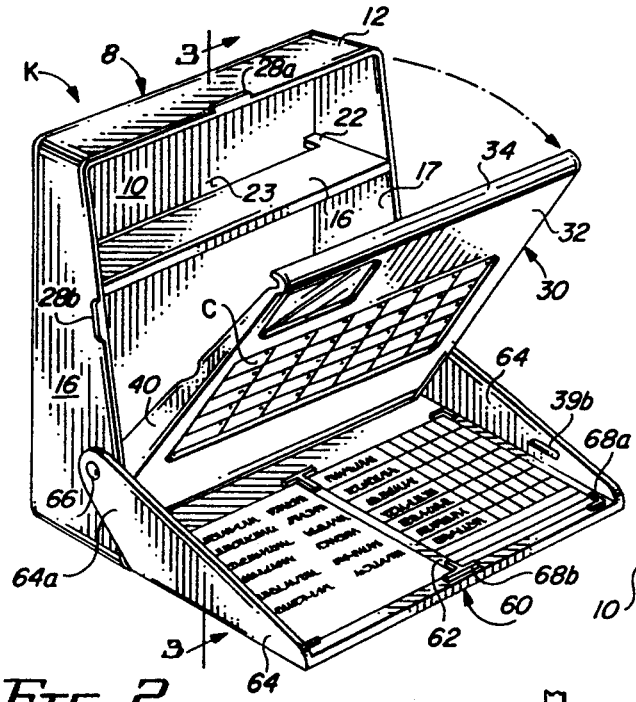
FIG. 2
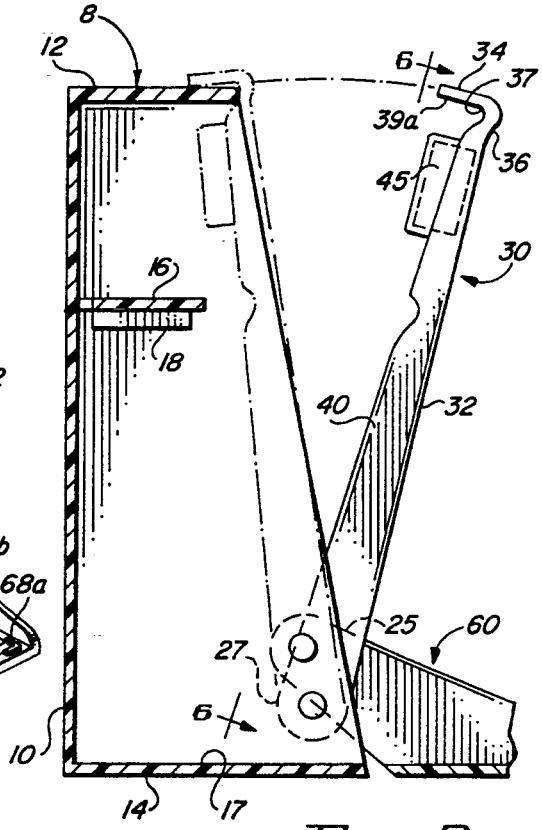
FIG. 3
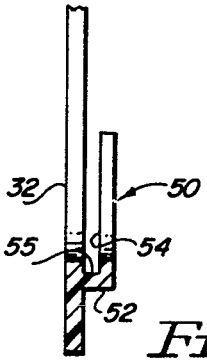
FIG. 7

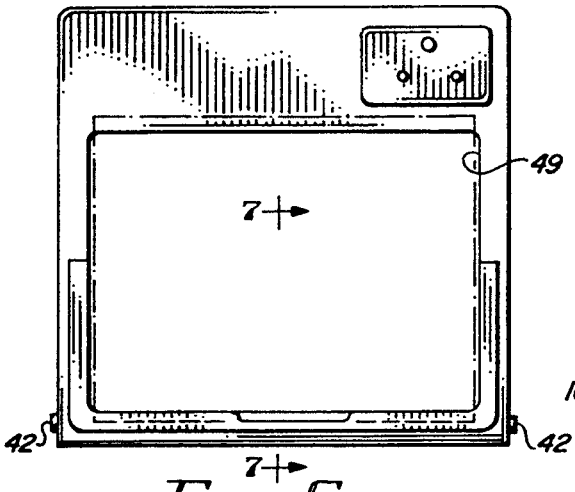
FIG. 6
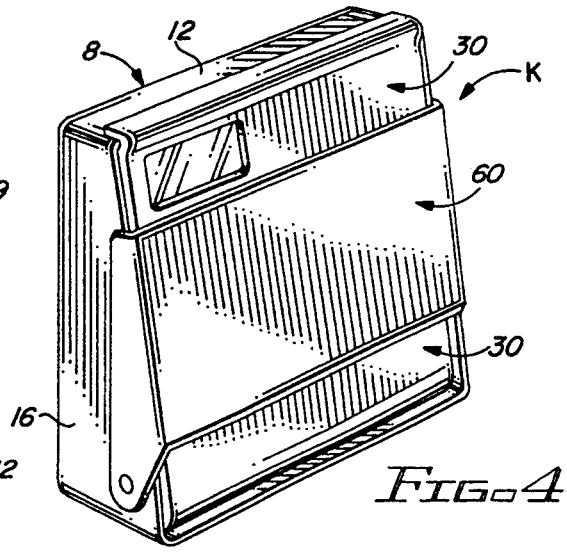
FIG. 4
THIS WEEK'S MEDICINE
WEEK ENDING: _____
| | MORNING | NOON | EVENING | NIGHT |
|---|---|---|---|---|
| SUNDAY | ☐ | ☐ | ☐ | ☐ |
| MONDAY | ☐ | ☐ | ☐ | ☐ |
| TUESDAY | ☐ | ☐ | ☐ | ☐ |
| WEDNEDAY | ☐ | ☐ | ☐ | ☐ |
| THURSDAY | ☐ | ☐ | ☐ | ☐ |
| FRIDAY | ☐ | ☐ | ☐ | ☐ |
| SATURDAY | ☐ | ☐ | ☐ | ☐ |
CHECK OFF EACH TIME DRUGS ARE TAKEN
MS
FIG. 8
FIG. 9
RX
| NAME OF DRUG | PURPOSE | TABLETS EACH TIME | MORNING | NOON | EVENING | NIGHT | DOCTOR'S NAME | REFILL DUE |
|---|---|---|---|---|---|---|---|---|
| | | | | | | | | |
| | | | | | | | | |
| | | | | | | | | |
| | | | | | | | | |
| | | | | | | | | |
| | | | | | | | | |
| | | | | | | | | |
| | | | | | | | | |
| | | | | | | | | |

PORTABLE MEDICINE CABINET ARRANGEMENT

BACKGROUND OF THE INVENTION

1. Field of the Invention

This invention relates to medicine cabinets and, more particularly, to a portable medicine cabinet arrangement for holding medicines and other related items that may be useful in helping to maintain a prescribed medication schedule for an individual.

2. Description of the Background Art

A background art search directed to the subject matter of this invention conducted in the United States Patent and Trademark Office disclosed the following United States Letters Patent:

| | | | |
|---|---|---|---|
| 569,359 | 603,467 | 678,284 | 2,441,345 |
| 3,851,940 | 3,915,526 | 4,127,311 | 4,194,628 |
| 4,241,833 | 4,660,991 | 4,731,765 | 4,955,679 |

None of the patents uncovered in the search discloses a portable, personal, medicine cabinet with a cabinet body having a shelved compartment for holding medicines and having an inner compartment cover and an outer cabinet cover, each hinged to the cabinet body and each including means for holding various printed materials relating to medication schedules, and wherein the inner compartment cover has extending therethrough an opening and retaining means adjacent the opening whereby material carried by the inner cover can be viewed from both sides of the inner cover.

SUMMARY OF THE INVENTION

It is a primary object of the invention to provide a portable, personal medicine cabinet for holding medicines and other items, such as a clock, calendar, a medication schedule, a record of medications taken, and related articles.

Another object of the invention is the provision, of a medicine cabinet that includes a cabinet body and a pair of inner and outer covers hinged to the cabinet body and designed to hold items of the type previously described.

A more specific object of the invention is to provide a portable medicine cabinet arrangement of the type described, wherein the inner cabinet compartment cover has, extending therethrough, an opening and means located adjacent the opening for holding printed material in such a way that the material can be read from either side of the compartment cover.

These and other objects of the invention will be apparent from an examination of the following description and drawings.

BRIEF DESCRIPTION OF THE DRAWINGS

FIG. 1 is a fragmentary isometric view of portable medicine cabinet embodying features of the present invention, with the inner compartment cover shown in a closed position and the outer cabinet cover shown in an open position;

FIG. 2 is a view similar to that of FIG. 1, but with the inner compartment cover also shown in a partly open position;

FIG. 3 is a fragmentary vertical sectional view taken on line 3—3 of FIG. 2;

FIG. 4 is a view similar to that of FIG. 2, but with the inner compartment cover and the outer cabinet cover each shown in a closed position;

FIG. 5 is an enlarged view of a portion of the structure illustrated in FIG. 1;

FIG. 6 is a rear elevational view of the inner compartment cover illustrated in FIGS. 1–4;

FIG. 7 is a reduced vertical sectional view taken on line 7—7 of FIG. 6;

FIGS. 8 and 9 are enlarged views of the informational material illustrated in FIG. 2.

It will be understood that, for purpose of clarity, certain elements may have been intentionally omitted from certain views where they are illustrated to better advantage in other views.

DESCRIPTION OF THE PREFERRED EMBODIMENT

Referring now to the drawings for a better understanding of the invention, as best seen in FIGS. 1–3 there is illustrated a portable, personal, medicine cabinet, indicated generally at K, that embodies features of the invention.

As previously mentioned, the purpose of the cabinet is to provide a single container for storing medicines, as well as other items required to help maintain medication schedules for one individual. It is especially useful for use in hospital or nursing home rooms, as well as in the home bedrooms of individuals.

Cabinet K, which may be formed molded plastic components, includes a hollow cabinet housing or body 8 that comprises a vertically disposed rear wall 10 having an integral top wall 12, a bottom wall 14, and side walls 16 extending forwardly therefrom to form therewith a hollow compartment 17.

Cabinet body 8 may be provided with at least one horizontally disposed shelf 20 supported at its ends by ledges 18 which are preferably formed integrally with and extend inwardly from the inner surfaces of body side walls 16.

As best seen in FIG. 2, shelf 20 may be provided at its ends with integral, rearwardly extending, arms 22 that provide a space 23 for storing one or more articles (not shown) between the front surface of body rear wall 10 and the rear surface of the shelf 20.

At their lower ends body side walls may be provided with sets of openings 25 and 27 for receiving projections 42 and 66 of the inner and outer covers 30 and 60, respectively, as hereinafter described.

The body top and side walls may also be provided with small, outwardly extending, projections or bosses 28*a* and 28*b* for engagement with inner and outer covers 30 and 60, respectively, as hereinafter described.

Inner compartment cover 30, as best seen in FIGS. 2 and 3, comprises a front wall 32 having an integral upper flange 34 and integral side flanges 40 extending rearwardly from the upper and side edges thereof.

As best seen in FIG. 3, the upper portion of inner cover front wall 32 is curved or bowed forwardly as indicated at 36 so as to form an inwardly facing lateral groove 35 for receiving the front edge of body top wall 12 when the inner cover is in a closed position. Also the upper ends of inner cover side flanges 40 may be recessed, as indicated at 37, to accommodate insertion of the body top wall into inner cover front wall groove 35.

Although the inner cover upper flange 34 fits over the outer surface of body top wall 12, when the inner cover is closed, the inner cover side flanges 40 fit inside of body side walls 16. Inner cover upper flange 34 may be provided with a depressions 39 for receiving the projection 28*a* of the body top wall to keep the inner cover in a closed position.

The lower ends of inner cover side flanges 40 may be provided with integral, outwardly extending, preferably cylindrical, projections 42 which are rotatably received within body side wall openings 25 to provide a hinged connection between the cabinet body and inner compartment cover. Also, side flanges 40 may be provided with recesses 43 to receive the front edge of shelf 20 when the inner cover is closed.

The front wall 32 of the inner cover 30 may be provided with recesses or pockets 45 and 47 for receipt of a battery operated clock 46 and a lock 48, if desired.

One of the important features of the invention is the arrangement of the inner cover front wall 32 which is designed to hold printed material that can be read from either the inside or the outside of the front wall.

Front wall 32, as best seen in FIGS. 6 and 7, has extending therethrough a relatively large, preferably generally rectangular opening 49. Formed integrally with the rear side of front wall 32 is a generally U-shaped retaining flange 50.

Flange 50 is located immediately adjacent the lower and side edges of opening 49. It is generally L-shaped in cross-section, comprising inner and outer sections 52 and 54 which form with the rear surface of front wall 32 a generally U-shaped channel 55 adapted to receive printed material such as a calendar and medication schedules.

The unique feature of this arrangement that is it permits two separate items to be placed back-to-back in the channel 55, so that one item, such as a calendar C, can be seen from the front side of the front wall and other items, such as medication schedules MS, can be seen from the rear side of the front wall.

In addition to inner compartment cover 30, there is provided an outer cabinet cover 60 which, as best seen in FIGS. 1, 2, and 4, comprises a main wall 62 with a pair of opposed, integral, side flanges 64 extending rearwardly from the side edges of the main wall 62.

Side flanges 64 have, at their lower ends, extended portions 64*a* that include integral, inwardly extending, cylindrical projections 66 adapted to be received within complementary openings 27 in cabinet body side walls 16 to provide a detachable hinged connection between cabinet body 8 and outer cabinet cover 60.

Outer cabinet cover side flanges 64 may be provided, at their upper ends, with depressions 28*b* adapted to receive cabinet body side wall bosses 39*b* to keep the outer cover in a closed position.

As best seen in FIG. 2, the inside of outer cover main wall may be provided with integral, inwardly extending, L-shaped projections 68*a* and T-shaped projections 68*b* that cooperate to form, with the inside surface of main wall 62, a pair of pockets 69*a* and 69*b*, respectively, adapted to receive other printed material such as the medication schedule MS, illustrated in FIG. 8, and the prescription record RX, illustrated in FIG. 9.

Thus, it should be understood that the invention provides a relatively inexpensive, compact, and extremely efficient device for storing the medications for an individual together with all of the printed material required to insure that the medications are taken as prescribed.

What is claimed is:

1. A portable, personal, medicine cabinet arrangement for holding medicines and other items required to help maintain a prescribed medication schedule for an individual, comprising:

(a) a cabinet body having a vertical rear wall and integral top, bottom, and side walls extending forwardly therefrom and forming with said rear wall a hollow compartment;

(b) said cabinet body including at least one horizontally disposed shelf in said compartment supported by said side walls;

(c) an inner compartment cover hinged, adjacent its lower end, to said cabinet body side walls and mounted for movement between a vertical closed position and a horizontal open position;

(d) said inner compartment cover including:

(i) a front wall having opposed upper and lower edges and opposed side edges;

(ii) integral upper and side flanges extending rearwardly from said inner cover front wall upper and side edges, respectively;

(e) said front wall including:

(i) a relatively large, generally rectangular opening extending therethrough and having opposed upper and lower edges and opposed side edges;

(ii) a generally U-shaped retaining flange extending rearwardly from said front wall, adjacent said opening lower and side edges, and forming with said front wall a channel for holding lower and side edge portions of printed material, so that opposite sides thereof can be seen from opposite sides of said front wall;

(iii) recessed areas, located above said opening, for holding a clock and a lock;

(f) an upper portion of said inner compartment front wall being curved forwardly to define a rearwardly facing, horizontally extending, groove adapted to receive a front edge portion of said cabinet body top wall when said inner cover is in closed position;

(g) an outer cabinet cover hinged, adjacent its lower end, to said cabinet body side walls and mounted for movement between a vertical closed position and a horizontal open position;

(h) said outer cabinet cover including a main wall with opposed side edges and integral side flanges extending rearwardly from said side edges;

(i) said main wall having, extending from an inner surface thereof, projections defining recesses for holding printed material;

(j) said cabinet body top and side walls having means engageable with said inner compartment cover upper flange and said outer cabinet cover side flanges, respectively, for maintaining each of said covers in a closed position.

2. A portable, personal, medicine cabinet arrangement for holding medicines and other items required to help maintain a prescribed medication schedule for an individual, comprising:

(a) a cabinet body having a vertical rear wall and integral top, bottom, and side walls extending forwardly therefrom and forming with said rear wall a hollow compartment;

(b) said cabinet body including at least one horizontal shelf in said compartment supported by certain of said walls;

(c) an inner compartment cover hinged, adjacent its lower end, to said cabinet body side walls and mounted for movement between a vertical closed position and a horizontal open position;

(d) said inner compartment cover including:
(i) a front wall having opposed upper and lower edges and opposed side edges;
(ii) integral upper and side flanges extending rearwardly from said inner cover front wall upper and side edges, respectively;
(e) said front wall including:
(i) a relatively large, generally rectangular opening extending therethrough and having opposed upper and lower edges and opposed side edges;
(ii) a generally U-shaped retaining flange extending rearwardly from said front wall, adjacent said opening lower and side edges, and forming with said front wall a channel for holding lower and side edge portions of printed material, so that opposite sides thereof can be seen from opposite sides of said front wall;
(f) an outer cabinet cover hinged, adjacent its lower end, to said cabinet body side walls and mounted for movement between a vertical closed position and a horizontal open position;
(g) said outer cabinet cover including a main wall with opposed side edges and integral side flanges extending rearwardly from said side edges;
(h) said outer cabinet cover including means for holding printed material on said main wall;
(i) said cabinet body top and side walls having means engageable with said inner compartment cover upper flange and said outer cabinet cover side flanges, respectively, for maintaining each of said covers in a closed position.

3. A portable, personal, medicine cabinet arrangement for holding medicines and other items required to help maintain a prescribed medication schedule for an individual, comprising:
(a) a cabinet body having a vertical rear wall and integral top, bottom, and side walls extending forwardly therefrom and forming with said rear wall a hollow compartment;
(b) said cabinet body including at least one horizontal shelf in said compartment supported by certain of said walls;
(c) an inner compartment cover hinged, adjacent its lower end, to said cabinet body side walls and mounted for movement between a vertical closed position and a horizontal open position;
(d) said inner compartment cover including:
(i) a front wall having opposed upper and lower edges and opposed side edges;
(ii) integral upper and side flanges extending rearwardly from said inner cover front wall upper and side edges, respectively;
(e) said front wall including:
(i) a relatively large, generally rectangular opening extending therethrough and having opposed upper and lower edges and opposed side edges;
(ii) a generally U-shaped retaining flange extending rearwardly from said front wall, adjacent said opening lower and side edges, and forming with said front wall a channel for holding lower and side edge portions of printed material, so that opposite sides thereof can be seen from opposite sides of said front wall;
(f) an outer cabinet cover hinged, adjacent its lower end, to said cabinet body side walls and mounted for movement between a vertical closed position and a horizontal open position;
(g) said outer cabinet cover including a main wall with opposed side edges and integral side flanges extending rearwardly from said side edges;
(h) said outer cabinet cover including means for holding printed material on said main wall.

4. A medicine cabinet arrangement according to claim 3, wherein said cabinet body top and side walls include means engageable with said inner compartment cover upper flange and said outer cabinet cover side flanges, respectively, for maintaining each of said covers in a closed position.

5. A medicine cabinet arrangement according to claim 2, wherein an upper portion of said inner compartment cover front wall is curved forwardly to define a rearwardly facing, horizontally extending groove adapted to receive a front edge portion of said cabinet body top wall when said inner compartment cover is in its closed position.

6. A medicine cabinet arrangement according to claim 3, wherein an upper portion of said inner compartment cover front wall is curved forwardly to define a rearwardly facing, horizontally extending, groove adapted to receive a front edge portion of said cabinet body top wall when said inner compartment cover is in its closed position.

7. A medicine cabinet arrangement according to claim 1, wherein said means for maintaining each of said covers in a closed position includes projections extending from said cabinet body top and side walls adapted to be received within complementary recesses in related flanges of said covers.

8. A medicine cabinet arrangement according to claim 2, wherein said means for maintaining each of said covers in a closed position includes projections extending from said cabinet body top and side walls adapted to be received within complementary recesses in related flanges of said covers.

9. A medicine cabinet arrangement according to claim 3, wherein said means for maintaining each of said covers in a closed position includes projections extending from said cabinet body top and side walls adapted to be received within complementary recesses in related flanges of said covers.

10. A medicine cabinet according to claim 1, wherein, when said inner compartment cover is in its closed position, said inner compartment cover side flanges are disposed inside of said cabinet body side walls, and said inner compartment cover upper flange is disposed outside of said cabinet body top wall.

11. A medicine cabinet according to claim 2, wherein, when said inner compartment cover is in its closed position, said inner compartment cover side flanges are disposed inside of said cabinet body side walls, and said inner compartment cover upper flange is disposed outside of said cabinet body top wall.

12. A medicine cabinet according to claim 3, wherein, when said inner compartment cover is in its closed position, said inner compartment cover side flanges are disposed inside of said cabinet body side walls, and said inner compartment cover upper flange is disposed outside of said cabinet body top wall.

13. A medicine cabinet according to claim 1, wherein said inner compartment cover has, extending outwardly from its side flanges, integral projections detachably receivable within complementary openings in said cabinet body side walls to provide a hinged connection between said cabinet body and said inner compartment cover.

14. A medicine cabinet according to claim 2, wherein said inner compartment cover has, extending outwardly from its side flanges, integral projections detachably receivable within complementary openings in said cabinet body side walls to provide a hinged connection between said cabinet body and said inner compartment cover.

15. A medicine cabinet according to claim 3, wherein said inner compartment cover has, extending outwardly from its side flanges, integral projections detachably receivable within complementary openings in said cabinet body side walls to provide a hinged connection between said cabinet body and said inner compartment cover.

16. A medicine cabinet according to claim 1, wherein said outer cabinet cover has, extending inwardly from its side flanges, integral projections detachably receivable within complementary openings in said cabinet body side walls to provide a hinged connection between said cabinet body and said outer compartment cover.

17. A medicine cabinet according to claim 2, wherein said outer cabinet cover has, extending inwardly from its side flanges, integral projections detachably receivable within complementary openings in said cabinet body side walls to provide a hinged connection between said cabinet body and said outer compartment cover.

18. A medicine cabinet according to claim 3, wherein said outer cabinet cover has, extending inwardly from its side flanges, integral projections detachably receivable within complementary openings in said cabinet body side walls to provide a hinged connection between said cabinet body and said outer compartment cover.

19. A medicine cabinet according to claim 3, wherein said shelf is mounted within said cabinet body compartment forwardly of said cabinet body rear wall to provide, between a rear surface of said shelf and a front surface of said cabinet rear wall, a space to accommodate storage of at least one article between said shelf and rear wall.

20. A medicine cabinet according to claim 3, wherein said inner compartment cover includes a recess for holding a clock.

* * * * *